US010293392B2

(12) United States Patent
Matsumoto et al.

(10) Patent No.: US 10,293,392 B2
(45) Date of Patent: May 21, 2019

(54) COILER DEVICE PROVIDED WITH CHUTE GUIDE

(71) Applicants: PRIMETALS TECHNOLOGIES JAPAN, LTD., Tokyo (JP); JFE STEEL CORPORATION, Tokyo (JP)

(72) Inventors: Hiroshi Matsumoto, Hiroshima (JP); Koichi Arai, Hiroshima (JP); Takayuki Endo, Tokyo (JP); Takao Uchiyama, Tokyo (JP); Tsutomu Sugiyama, Tokyo (JP); Takeshi Chiba, Tokyo (JP)

(73) Assignees: PRIMETALS TECHNOLOGIES JAPAN, LTD., Tokyo (JP); JFE STEEL CORPORATION, Tokyo (JP)

( * ) Notice: Subject to any disclaimer, the term of this patent is extended or adjusted under 35 U.S.C. 154(b) by 2 days.

(21) Appl. No.: 15/127,265

(22) PCT Filed: Mar. 18, 2015

(86) PCT No.: PCT/JP2015/057978
§ 371 (c)(1),
(2) Date: Sep. 19, 2016

(87) PCT Pub. No.: WO2015/141704
PCT Pub. Date: Sep. 24, 2015

(65) Prior Publication Data

US 2017/0106423 A1 Apr. 20, 2017

(30) Foreign Application Priority Data

Mar. 20, 2014 (JP) ..... 2014-059067

(51) Int. Cl.
*B21C 47/34* (2006.01)
*B21C 47/06* (2006.01)

(52) U.S. Cl.
CPC ..... *B21C 47/3441* (2013.01); *B21C 47/06* (2013.01); *B21C 47/3433* (2013.01)

(58) Field of Classification Search
CPC ..... B21C 47/3441; B21C 47/3433; B21C 47/02; B21C 47/34; B21C 47/10;
(Continued)

(56) References Cited

U.S. PATENT DOCUMENTS 2,700,907 A * 2/1955 Durst ..... B23K 20/04 29/238
3,233,444 A * 2/1966 Groves ..... B21H 7/007 29/896.91
(Continued)

FOREIGN PATENT DOCUMENTS

DE 198 36 177 A1 3/1999
JP 64-6977 Y 2/1989
(Continued)

OTHER PUBLICATIONS

Extended European Search Report dated Nov. 8, 2017 in corresponding European Application No. 15764495.6.
(Continued)

*Primary Examiner* — Debra M Sullivan
(74) *Attorney, Agent, or Firm* — Birch, Stewart, Kolasch & Birch, LLP

(57) ABSTRACT

This coiler device provided with a chute guide has: pinch rollers that lead a metal sheet carried in along a path line to a coil-up line that is curved from the path line; a mandrel that is disposed ahead of the coil-up line and coils up the metal sheet; and a chute guide that guides the upward-facing surface side of the metal sheet at the coil-up line and introduces the metal sheet to the coil-up opening of the mandrel. A configuration is adopted such that the chute guide has: a main body frame; and a liner that is attached to
(Continued)

the main body frame, forms at least a portion of the guide surface that guides the metal sheet, has a lower coefficient of friction than the main body frame, and has a lower hardness than the metal sheet.

6 Claims, 6 Drawing Sheets

(58) Field of Classification Search
CPC ..... B21B 39/14; B21B 41/00; B21B 39/16; B65H 2301/448
USPC ..... 72/146, 148
See application file for complete search history.

(56) References Cited

U.S. PATENT DOCUMENTS 4,074,553 A * 2/1978 Woodrow ..... B21C 47/143 138/120
4,137,746 A * 2/1979 Arnhold ..... B21D 5/0209 72/389.3
6,039,283 A * 3/2000 Munoz-Baca ..... B21C 47/34 242/531.1
2010/0083720 A1* 4/2010 Hackenberg ..... B21B 38/02 72/8.6

FOREIGN PATENT DOCUMENTS

JP 2001-191114 A 7/2001
JP 2005-305452 A 11/2005
JP 2012-250283 A 12/2012

OTHER PUBLICATIONS

Office Action dated Jan. 2, 2018 issued in the corresponding Chinese Application No. 201580014849.7 with an English Translation.
Korean Office Action dated May 9, 2018 issued in corresponding Korean Application No. 2016-7025460 with an English Translation.
Korean Office Action dated Nov. 13, 2017 issued in corresponding Korean Application No. 2016-7025460 with an English Translation.

* cited by examiner

COILER DEVICE PROVIDED WITH CHUTE GUIDE

TECHNICAL FIELD

The present invention relates to a coiler device provided with a chute guide.

BACKGROUND ART

In general, a coiler device (a winder) is provided on an exit side of a rolling line, and is configured to wind a metal strip (a strip) into a coil shape, where the metal strip is rolled by a rolling mill and continuously supplied from a gap between rollers. The coiler device is provided with pinch rollers located on a pass line for the metal strip, and is configured to cause the pinch rollers to guide the metal strip to a winding line which is bent obliquely downward from the pass line, to allow a leading end of the metal strip to be caught by a mandrel, and to wind up the metal strip (see Patent Document 1).

Patent Document 1 cited below discloses a method and an apparatus for winding a strip, which are designed to wind a rolled strip around a mandrel through pinch rollers. The coiler device includes a chute and an over-guide (a chute guide) which introduce a metal strip into a winding port that is formed by the mandrel and a wrapper roller. The over-guide is configured to function as a guide plate which guides an upper surface side of the metal strip introduced into the winding line.

PRIOR ART DOCUMENT

Patent Document

Patent Document 1: Japanese Patent Application Publication No. 2005-305452

SUMMARY OF THE INVENTION

Problem to be Solved by the Invention

In the meantime, after having passed through the pinch rollers, the metal strip is guided to the mandrel while deflecting its passing angle obliquely downward. Here, if the metal strip is a high-strength thick material, the metal strip is not bent very much due to its high bending stiffness, and is therefore thrust hard against the chute guide that guides the upper surface side of the metal strip in the winding line. As a consequence, a surface of the metal strip is vulnerable to flaws and frictional resistance thereon is increased as well. Hence, a large pushing force is required and energy consumption is also increased accordingly.

The present invention has been made in view of the above-mentioned problem. An object of the present invention is to provide a coiler device provided with a chute guide, which is capable of preventing occurrence of flaws on a surface of a metal strip and stabilizing strip passage even when the metal strip is a high-strength thick material.

Means for Solving the Problems

In order to solve the problem described above, the present invention adopts a configuration of a coiler device provided with a chute guide, characterized by: a pinch roller configured to guide a metal strip being conveyed along a pass line to a winding line bent from the pass line; a mandrel disposed ahead of the winding line and configured to wind up the metal strip; and a chute guide configured to guide an upper surface side of the metal strip in the winding line, and to introduce the metal strip into a winding port of the mandrel. The chute guide includes a body frame, and a liner being attached to the body frame, constituting at least part of a guide surface to guide the metal strip, and having a lower friction coefficient than a friction coefficient of the body frame and a lower hardness than a hardness of the metal strip.

As a consequence of adopting this configuration, in the present invention, at least part of the guide surface is formed from the liner having the lower friction than that of the body frame constituting the chute guide and having the lower hardness than that of the metal strip. The presence of the liner can reduce frictional resistance on the guide surface. Accordingly, it is possible to reduce energy consumption since it is not necessary to apply a very large pushing force to the metal strip. Moreover, since the liner has the lower hardness than that of the metal strip, it is the liner which is scraped off when the metal strip is thrust thereon. Thus, a surface of the metal strip is prevented from the occurrence of flaws (from being scraped off).

In addition, the present invention adopts a configuration in which the liner is attached to a downstream side of the body frame in the winding line.

As a consequence of adopting this configuration, in the present invention, in the winding line, the downstream side of the chute guide being close to a winding port of the mandrel rubs against the metal strip for a longer period than does the upstream side thereof. Accordingly, by attaching the liner to the downstream side of the body frame, it is possible to effectively prevent an increase in frictional resistance on the guide surface and to prevent the occurrence of flaws on the surface of the metal strip.

In addition, the present invention adopts a configuration in which the coiler device includes an attachment unit configured to detachably attach the liner to the body frame.

As a consequence of adopting this configuration, in the present invention, it is possible to replace only the liner which rubs against the metal strip and gradually wears away. Thus, replacement workability is improved as compared to a case of replacing the liner together with the body frame, and a replacement cost can be reduced as well.

In addition, the present invention adopts a configuration in which the attachment unit includes: a frame body provided to the body frame; a slide groove provided in the liner; a slide piece configured to be engaged with the slide groove, and to sandwich the frame body in conjunction with the liner; and a screw member configured to fasten and fix the slide piece to the liner.

As a consequence of adopting this configuration, in the present invention, the liner can be detached from the frame body provided to the body frame by releasing fastening and fixation with the screw member and then moving the slide piece along the slide groove of the liner to release engagement with the liner. Accordingly, even if the fastening and fixation by the screw member is released, for instance, the liner remains supported by the body frame unless the engagement of the slide piece with the liner is released. Thus, it is possible to surely avoid a circumstance such as the liner being unexpectedly falling off and getting caught in the metal strip.

In addition, the present invention adopts a configuration in which the slide piece includes an engagement protrusion configured to be engaged with the slide groove, and the slide groove includes a first opening opened with a larger width than a width of the engagement protrusion, and a second opening opened with a smaller width than the width of the engagement protrusion.

As a consequence of adopting this configuration, in the present invention, the slide piece and the liner can be easily brought into engagement with each other by introducing the engagement protrusion of the slide piece from the first opening into the slide groove and then causing the engagement protrusion to slide to the second opening.

In addition, the present invention adopts a configuration in which the liner includes a plurality of pieces arranged in a width direction of the winding line, and the plurality of pieces are detachably attached to the body frame independently of each other.

As a consequence of adopting this configuration, in the present invention, when the metal strip is rolled out of a rolling mill, a shape of a leading end of the metal strip often fails to be aligned straight, and the liner may be worn unevenly in the width direction. Hence, by forming the liner from the multiple pieces so as to be replaceable partially in terms of the width direction, it is possible to further reduce the replacement cost.

Effect of the Invention

According to the present invention, it is possible to obtain a coiler device provided with a chute guide, which is capable of preventing occurrence of flaws on a surface of a metal strip and stabilizing strip passage even when the metal strip is a high-strength thick material.

MODES FOR CARRYING OUT THE INVENTION

Embodiments of the present invention will be described below with reference to the drawings.

Figure 1:
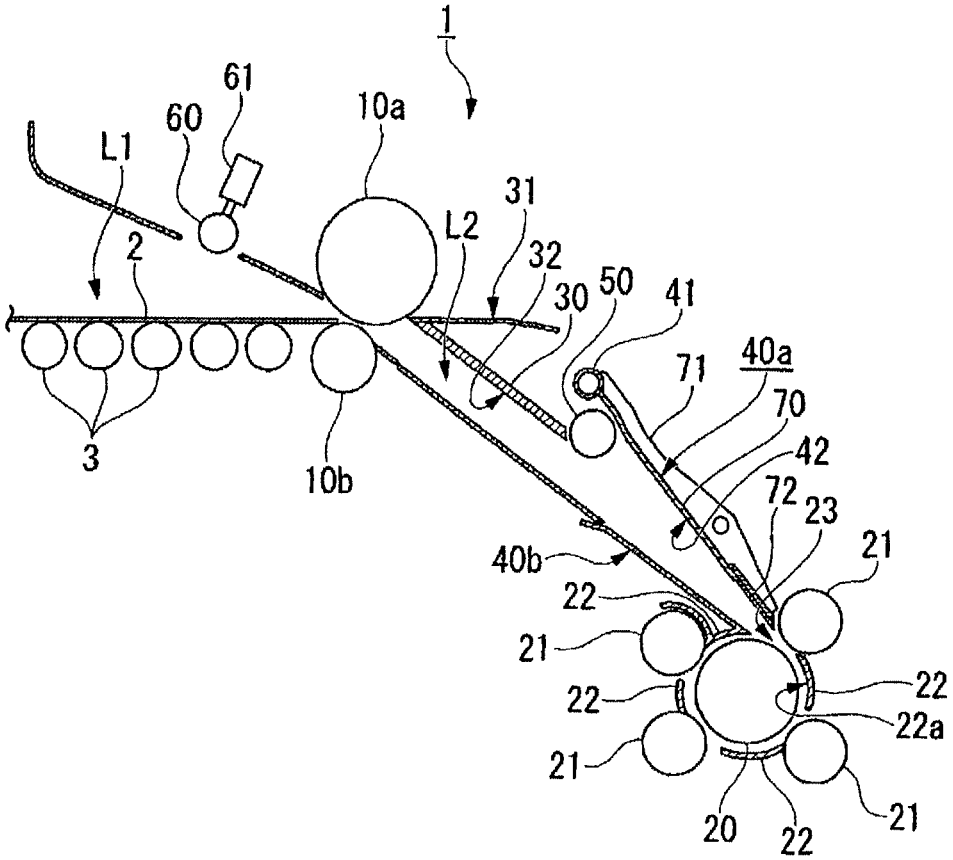
FIG. 1 is an overall configuration diagram showing a coiler device according to an embodiment of the present invention.

FIG. 1 is an overall configuration diagram showing a coiler device 1 according to an embodiment of the present invention.

As shown in FIG. 1, the coiler device 1 is disposed on a downstream side of a not-illustrated rolling mill, and is configured to introduce a metal strip 2, which passes through the rolling mill and is conveyed along a pass line L1, to a winding line L2 and thereby winding up the metal strip 2. The pass line L1 is defined by multiple conveyance rollers 3 that are arranged horizontally.

The coiler device 1 includes pinch rollers 10*a* and 10*b*. The pinch rollers 10*a* and 10*b* are designed to guide the metal strip 2, which is conveyed along the pass line L1, to the winding line L2 that is bent from the pass line L1. The winding line L2 extends obliquely downward from the pass line L1. The upper pinch roller 10*a* is made capable of approaching and receding from the lower pinch roller 10*b*. The upper pinch roller 10*a* is designed to recede from the lower pinch roller 10*b* except in the case of winding the metal strip 2 around a mandrel 20 to be described below.

The coiler device 1 includes the mandrel 20. The mandrel 20 is disposed ahead of the winding line L2 and designed to wind up the metal strip 2. Multiple wrapper rollers 21 and wrapper aprons 22 are provided around the mandrel 20. The wrapper rollers 21 are provided for wrapping the metal strip 2 around the mandrel 20. The wrapper rollers 21 are disposed at intervals in a circumferential direction of the mandrel 20. The wrapper rollers 21 are made capable of approaching and receding from the mandrel 20. The wrapper rollers 21 are designed to move in conformity with a diameter of the metal strip 2 wrapped around the mandrel 20.

The wrapper aprons 22 are designed to lead a leading end of the metal strip 2 when the metal strip 2 is wrapped around the mandrel 20. Each wrapper apron 22 has a guide surface 22*a*, which is opposed to a peripheral surface of the mandrel 20, and allows the leading end of the metal strip 2 to come into contact therewith. The guide surface 22*a* is curved along the peripheral surface of the mandrel 20. Each wrapper apron 22 is disposed in a space between two corresponding wrapper rollers 21 adjacent to each other in the circumferential direction of the mandrel 20. The wrapper aprons 22 are made capable of approaching and receding from the mandrel 20. The wrapper aprons 22 are designed to recede from the mandrel 20 when the metal strip 2 is wrapped therearound.

The coiler device 1 includes a gate 30. The gate 30 is configured to open and close the winding line L2 (FIG. 1 shows an open state). The gate 30 is disposed on an exit side of the pinch rollers 10*a* and 10*b*. The gate 30 includes a first guide surface 31 that defines the pass line L1, and a second guide surface 32 that defines the winding line L2. The first guide surface 31 is formed into a horizontal surface extending along the pass line L1. The second guide surface 32 is formed into an inclined surface extending along the winding line L2. The gate 30 has a structure in which a tip end of a substantially V shape is directed to an upstream side of the pass line L1.

The gate 30 defines the winding line L2 in conjunction with chute guides 40*a* and 40*b*. The chute guides 40*a* and 40*b* are designed to guide the leading end of the metal strip 2 to the winding port 23 between the mandrel 20 and the corresponding wrapper roller 21. The chute guides 40*a* and 40*b* are arranged in a downward tapered fashion such that a clearance therebetween is gradually narrowed toward the catch part between the mandrel 20 and the wrapper roller 21. The chute guides 40*a* and 40*b* are disposed on a downstream side of the gate 30 in the winding line L2. In this embodiment, the lower chute guide 40*b* is provided integrally with one of the wrapper aprons 22. Meanwhile, the upper chute guide 40*a* is provided turnably about a rotating shaft 41.

The coiler device 1 includes a chute roller 50. The chute roller 50 is configured to suppress a deformation of the metal strip 2 in such a way as to be curved toward its upper surface side when the leading end of the metal strip 2 is wrapped around the mandrel 20. The chute roller 50 is disposed at a position corresponding to a joint between the gate 30 and the upper chute guide 40*a*, which is disposed on the downstream side of the gate 30 on the winding line L2. The chute roller 50 is rotatably provided and its peripheral surface projects from the second guide surface 32.

The coiler device 1 includes a bending roller 60. The bending roller 60 is disposed on an upstream side of the pinch rollers 10*a* and 10*b*, and is made capable of approaching and receding from the pass line L1 by use of a bending roller drive device 61. The bending roller 60 is configured to approach the pass line L1 when the rolling of the metal strip 2 is about to finish, so as to prevent its trailing end from bouncing up. The bending roller drive device 61 is formed from a cylinder device, for example.

Next, a configuration of the chute guide 40*a* will be described in detail while additionally referring to FIG. 2 to FIG. 6.

Figure 2:
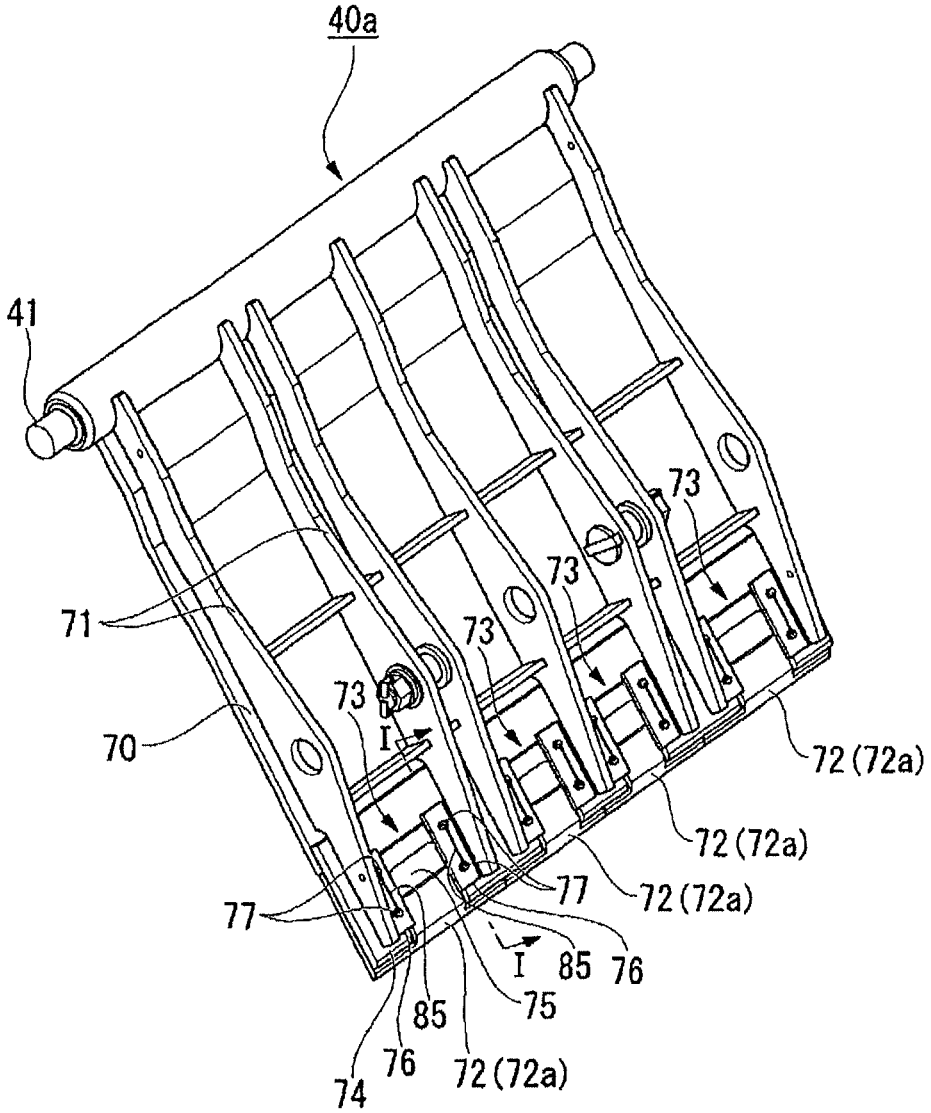
FIG. 2 is a perspective view of a chute guide according to the embodiment of the present invention, which is viewed from a back side.
Figure 3:
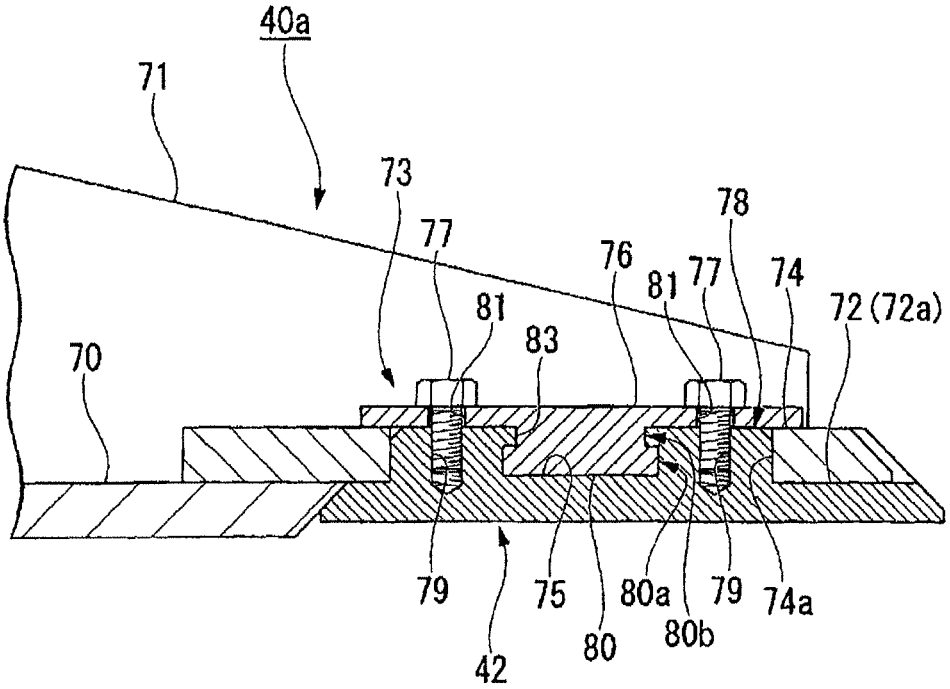
FIG. 3 is a cross-sectional view taken along and viewed in a direction of arrows I-I in FIG. 2.
Figure 4:
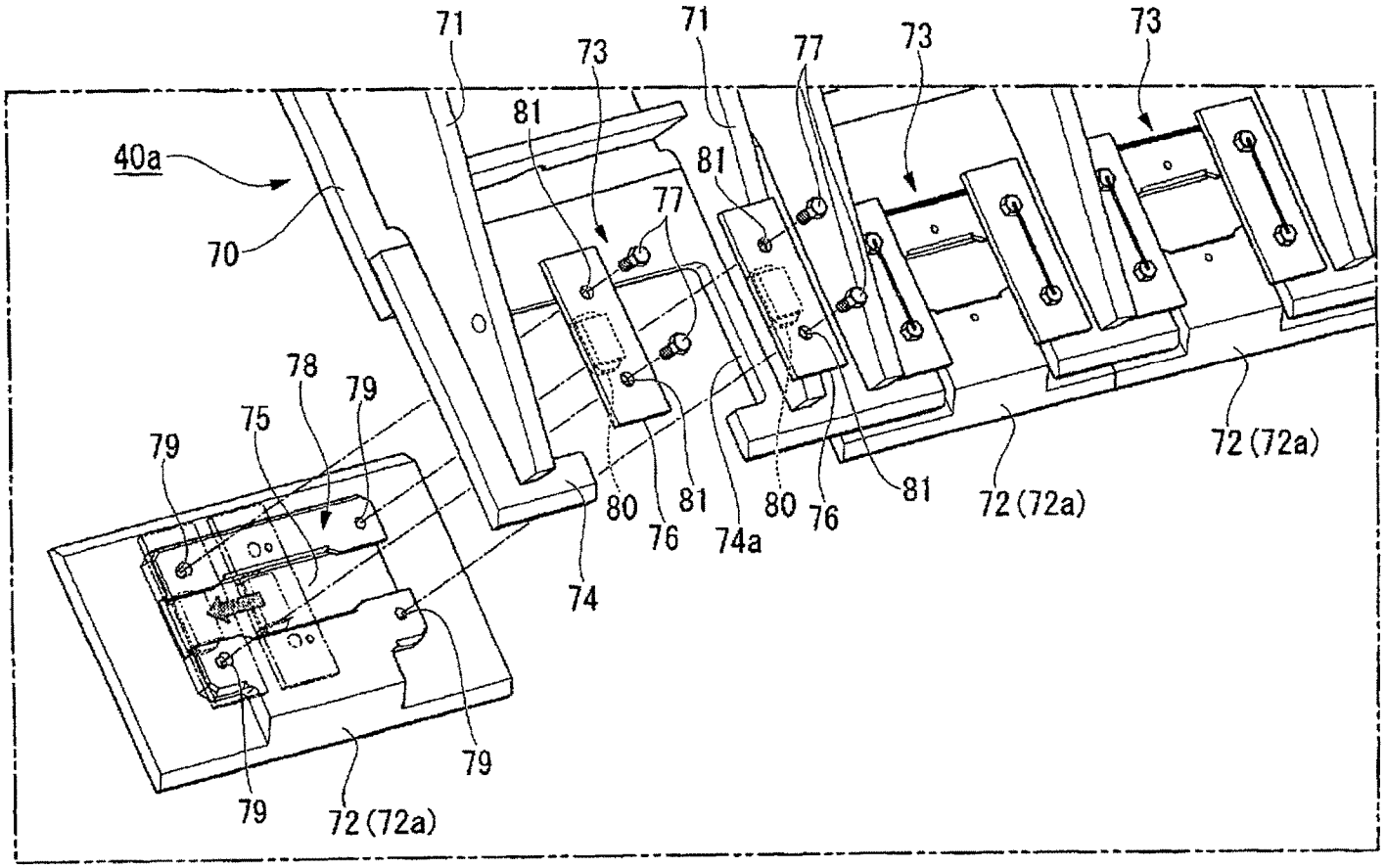
FIG. 4 is an exploded perspective view showing attachment units according to the embodiment of the present invention.
Figure 5:
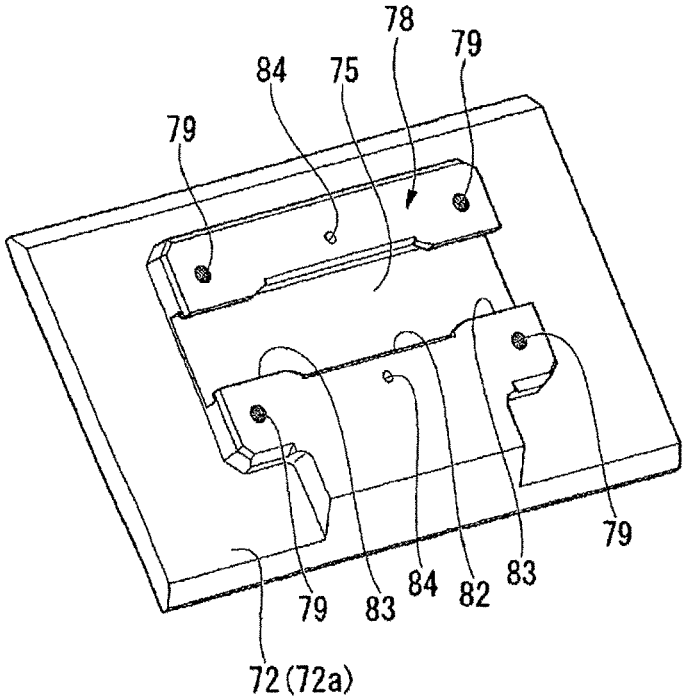
FIG. 5 is a perspective view showing a liner according to the embodiment of the present invention.
Figure 6:
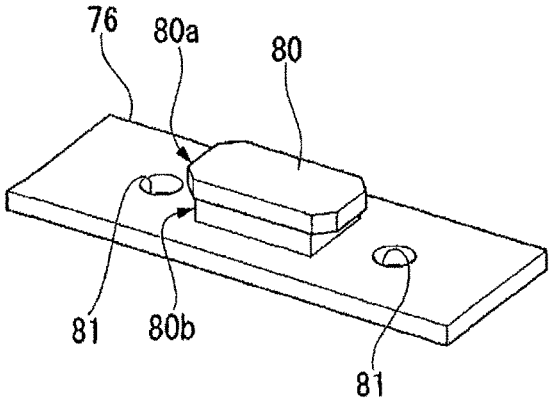
FIG. 6 is a perspective view showing a slide piece according to the embodiment of the present invention.

FIG. 2 is a perspective view of the chute guide 40*a* according to the embodiment of the present invention, which is viewed from a back side. FIG. 3 is a cross-sectional view taken along and viewed in a direction of arrows I-I in FIG. 2. FIG. 4 is an exploded perspective view showing attachment units 73 according to the embodiment of the present invention. FIG. 5 is a perspective view showing a liner 72 according to the embodiment of the present invention. FIG. 6 is a perspective view showing a slide piece 76 according to the embodiment of the present invention.

The chute guide 40*a* is configured to guide the upper surface side of the metal strip 2 introduced into the winding line L2 (see FIG. 1), and to introduce the metal strip 2 into the winding port 23 of the mandrel 20. The chute guide 40*a* includes a body frame 70. A front side of the body frame 70 forms a guide surface 42 that guides the upper surface side of the metal strip 2. As shown in FIG. 2, multiple reinforcement ribs 71 are provided on a back side of the body frame 70.

The chute guide 40*a* includes the liner 72. As shown in FIG. 1, the liner 72 is attached to the body frame 70, and constitutes at least part of the guide surface 42 that guides the metal strip 2. The liner 72 is formed from a low friction material having a lower friction coefficient than that of the body frame 70, which is also a low hardness material having a lower hardness than that of the metal strip 2. The liner 72 of this embodiment is made of an FCD (ductile cast iron) material, for example.

As shown in FIG. 1, the liner 72 is attached to a downstream side of the body frame 70 in the winding line L2. The liner 72 of this embodiment forms a portion of the guide surface 42 that accounts for about one-fifth starting from a downstream end of the body frame 70. A downstream end of the liner 72 projects from the downstream end of the body frame 70 and is disposed in proximity to a peripheral surface of the first wrapper roller 21. Moreover, as shown in FIG. 2, the liner 72 is formed from multiple pieces 72*a* arranged in a width direction of the winding line L2. The liner 72 of this embodiment adopts a configuration including four pieces 72*a*, so that each of the four pieces 72*a* is independently replaceable.

As shown in FIG. 3, the chute guide 40*a* includes attachment units 73. The attachment units 73 are configured to detachably attach the liner 72 to the body frame 70. The attachment units 73 of this embodiment are configured to detachably attach the respective pieces 72*a* of the liner 72 to the body frame 70 independently of one another (see FIG. 2 and FIG. 4). Each attachment unit 73 includes a frame body 74, a slide groove 75, slide pieces 76, and screw members 77.

As shown in FIG. 4, the frame body 74 is provided to the body frame 70. Specifically, the frame body 74 is provided on the downstream side of the body frame 70 in the winding line L2, and forms an integral structure with the body frame 70. A fitting hole 74*a* in a convex shape with its leading end directed to the downstream side of the winding line L2 is formed on an inner side of the frame body 74. The fitting hole 74*a* is formed between the reinforcement ribs 71 that are adjacent to each other.

The slide groove 75 is provided in the liner 72 as shown in FIG. 4. The liner 72 includes a convex projection 78 to be fitted into the fitting hole 74*a* of the frame body 74. The slide groove 75 is formed in the projection 78. Screw holes 79 to be threadedly engaged with the screw members 77 are formed in the projection 78. The screw holes 79 are formed at four positions in total, namely, at two positions each while interposing the slide groove 75 in between. As shown in FIG. 3, the screw holes 79 are formed so as not to penetrate or reach the guide surface 42.

As shown in FIG. 3, each slide piece 76 is configured to be engaged with the slide groove 75, and to sandwich the frame body 74 in conjunction with the liner 72. As shown in FIG. 4, this embodiment adopts a configuration in which the two slide pieces 76 are engaged with the single slide groove 75. Each slide piece 76 includes an engagement protrusion 80 to be engaged with the slide groove 75. As shown in FIG. 3, the engagement protrusion 80 is formed into a T-shape in a cross-sectional view. Specifically, as shown in FIG. 6, the engagement protrusion 80 is formed from a head portion 80*a* having a large width, and a neck portion 80*b* having a smaller width. The slide piece 76 includes insertion holes 81 to allow insertion of the screw members 77, which are formed at two positions in total, namely, at one position each while interposing the engagement protrusion 80 in between.

As shown in FIG. 5, the slide groove 75 includes a first opening 82 which is opened at a large width, and second openings 83 which are opened at a small width. The first opening 82 enables introduction of the engagement protrusion 80 of the slide piece 76, and is opened at a larger width than a width of the engagement protrusion 80 (the head portion 80*a*). In the meantime, the second openings 83 enable engagement with the engagement protrusion 80 of the slide piece 76, and are opened at a smaller width than the width of the engagement protrusion 80 (the head portion 80*a*). Note that hooks are fitted into holes 84 shown in FIG. 5 at the time of slinging up the liner 72.

The first opening 82 is disposed at a central part of the slide groove 75 while the second openings 83 are disposed on two end portions of the slide groove 75. Each second opening 83 is configured to reduce an opening width of the slide groove 75 down to the width of the neck portion 80*b* of the engagement protrusion 80. As shown in FIG. 3, the two end portions of the slide groove 75 are formed into a T-shape in a cross-sectional view so as to correspond to the engagement protrusion 80, thereby enabling the engagement with the slide pieces 76. The liner 72 and the slide pieces 76 are formed greater than the fitting hole 74*a*, so that the frame body 74 can be sandwiched from the front and the back by engaging the liner 72 with the slide pieces 76.

The screw members 77 are configured to fasten and fix the slide pieces 76 to the liner 72. Each screw member 77 passes through the insertion hole 81 and is threadedly engaged with the screw hole 79, thereby preventing disengagement while restricting movement of the slide piece 76 along the slide groove 75, and constricting the frame body 74 between the liner 72 and the slide piece 76 at the same time. As shown in FIG. 2, the screw members 77 fasten and fix the slide piece 76 at the two positions. Note that in this embodiment, the screw members 77 are connected to each other with wiring 85 so as to keep them from turning and loosening.

Next, an operation to wind the metal strip 2 by the coiler device 1 having the above-described configuration and an action of the chute guide 40*a* will be described with reference to FIG. 7. Note that a description is given below of a case where the metal strip 2 is a high-strength thick material.

Figure 7:
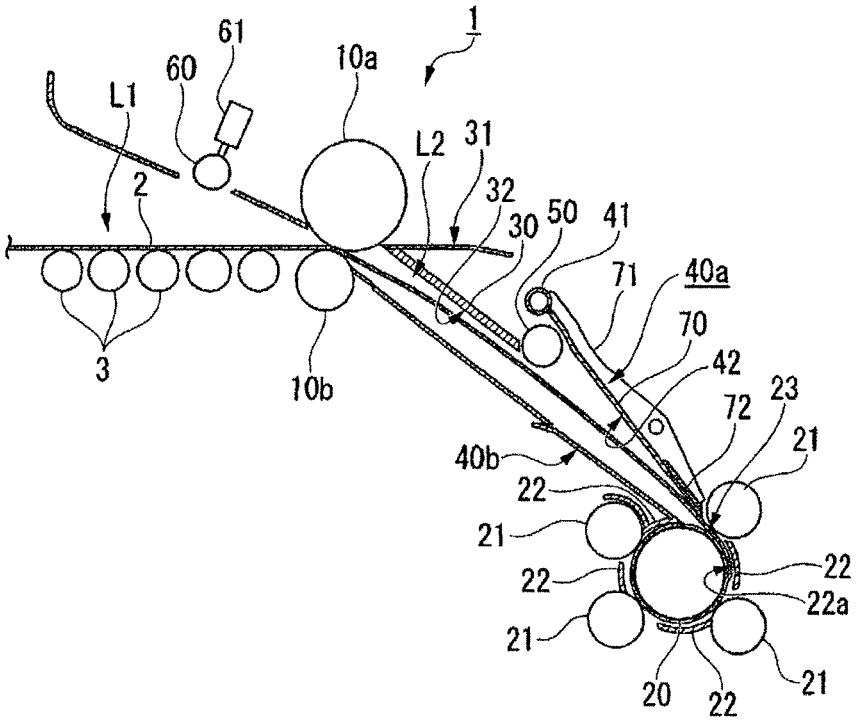
FIG. 7 is a diagram for explaining a winding operation of the coiler device and an action of the chute guide according to the embodiment of the present invention.

FIG. 7 is a diagram for explaining a winding operation of the coiler device 1 and an action of the chute guide 40*a* according to the embodiment of the present invention.

As shown in FIG. 7, the metal strip 2 having passed through the not-illustrated rolling mill is conveyed along the pass line L1 and reaches the pinch rollers 10*a* and 10*b*. After having passed through the pinch rollers 10*a* and 10*b*, the metal strip 2 changes its passing angle obliquely downward and is hence guided to the winding line L2 which is bent from the pass line L1. Here, when the metal strip 2 is the high-strength thick material, its leading end is not bent enormously but is instead curved in such a way as to draw an arc. As a consequence, the metal strip 2 is thrust against the chute guide 40*a* in the winding line L2.

The chute guide 40*a* includes the guide surface 42 which guides the upper surface side of the metal strip 2 introduced into the winding line L2. At least part of the guide surface 42 is formed from the liner 72. The liner 72 is made of the low friction material having the lower friction coefficient than that of the body frame 70 constituting the chute guide 40*a*, and thus reduces frictional resistance against the metal strip 2. In this way, by attaching the liner 72 to the body frame 70 and reducing the frictional resistance on the guide surface 42, it is possible to reduce energy consumption since it is not necessary to apply a very large pushing force to the metal strip 2.

Moreover, since the liner 72 is made of the low hardness material having the lower hardness than that of the metal strip 2, it is the liner 72 which is scraped off when the metal strip 2 is thrust thereon. Thus, the surface of the metal strip 2 is prevented from the occurrence of flaws (from being scraped off). Accordingly, in this embodiment, at least part of the guide surface 42 is formed from the liner 72 having the lower friction than that of the body frame 70 constituting the chute guide 40*a* and having the lower hardness than that of the metal strip 2. Thus, it is possible to reduce the frictional resistance, to stabilize strip passage without the need to apply a large pushing force to the metal strip 2, and meanwhile, to prevent the occurrence of flaws on the surface of the metal strip 2 by abrading the liner 72 side.

As shown in FIG. 7, the leading end of the metal strip 2 introduced into the winding line L2 is thrust at the body frame 70. Thereafter, the metal strip 2 is thrust at the liner 72 disposed on the downstream side of the winding line L2, then passes through the winding port 23, and is wound around the mandrel 20. When the metal strip 2 is the high-strength thick material, as the metal strip 2 is wound around the mandrel 20 one time, a downstream side thereof is lifted up by its leading end that gets into a bottom side. Hence, the metal strip 2 will remain thrust at the downstream side of the chute guide 40*a* for some time while being wound around the mandrel 20.

As described above, in the winding line L2, the metal strip 2 is thrust on the downstream side of the chute guide 40*a* for a longer period than is thrust on the upstream side thereof. The liner 72 of this embodiment is attached to the downstream side of the body frame 70 in the winding line L2. According to this configuration, it is possible to effectively prevent an increase in frictional resistance on the guide surface 42 on the downstream side, which is close to the winding port 23 of the mandrel 20 and rubs against the metal strip 2 for a long period, and to effectively prevent the occurrence of flaws on the surface of the metal strip 2.

Meanwhile, the liner 72 of this embodiment is detachably attached to the body frame 70 by using the attachment units 73. Accordingly, it is possible to replace only the liner 72, which rubs against the metal strip 2 and gradually wears away, separately from the body frame 70. As a consequence, replacement workability is improved as compared to the case of replacing the liner 72 together with the body frame 70, and a replacement cost can be reduced as well. Moreover, as shown in FIG. 2, the liner 72 is formed from the multiple pieces 72*a* arranged in the width direction of the winding line L2, and the multiple pieces 72*a* are detachably attached to the body frame 70 independently of one another. A weight of each of the pieces 72*a* is obviously lighter than a total weight of the liner 72, and it is therefore easy to conduct replacement work.

In the meantime, when the metal strip 2 is rolled out of the not-illustrated rolling mill, the shape of the leading end of the metal strip 2 often fails to be aligned straight. Accordingly, when the leading end of the metal strip 2 is thrust at the chute guide 40*a*, the liner 72 may be worn unevenly in the width direction. In this embodiment, the liner 72 is formed from the multiple pieces 72*a* so as to be replaceable partially in terms of the width direction, thereby allowing the replacement of only the unevenly worn part, for example. As a consequence, it is possible to further reduce the replacement cost for the liner 72.

The attachment of the liner 72 of this embodiment is conducted as illustrated in FIG. 4. First, the liner 72 is slung up with a wire and the projection 78 is fitted from a top side of the frame body 74 into the fitting hole 74*a*. Next, the slide pieces 76 are brought into engagement with the slide groove 75 from a back side of the frame body 74. Specifically, the engagement protrusion 80 of each slide piece 76 is introduced from the first opening 82 into the slide groove 75, and is then caused to slide to the second opening 83. Thus, the slide piece 76 and the liner 72 are engaged with each other. After the slide pieces 76 are brought into engagement with the two end portions of the slide groove 75, respectively, the slide pieces 76 are fastened and fixed to the liner 72 by using the screw members 77. In this way, the attachment of the liner 72 is completed.

The detachment of the liner 72 is conducted in a reverse procedure to the above-described attachment. Specifically, the fastening and fixation by the screw members 77 is released and then the slide pieces 76 are moved along the slide groove 75 of the liner 72 to release the engagement with the liner 72. Thus, the liner 72 can be detached from the frame body 74 provided to the body frame 70.

As shown in FIG. 3, according to the configuration of the attachment units 73, even if the fastening and fixation by the screw members 77 is released, for instance, the liner 72 remains supported by the body frame 70 unless the engagement of the slide pieces 76 with the liner 72 is released. As a consequence, at the time of the replacement, it is possible to surely avoid an unforeseen circumstance such as the liner 72 unexpectedly falling off and either getting caught in the metal strip 2 or colliding with a peripheral device, and thus to perform the replacement work safely and reliably.

In this way, the above-described embodiment adopts the configuration of the coiler device 1 provided with the chute guide 40*a*, including: the pinch rollers 10*a* and 10*b* configured to guide the metal strip 2, which is conveyed along the pass line L1, to the winding line L2 bent from the pass line L1; the mandrel 20 disposed ahead of the winding line L2 and configured to wind up the metal strip 2; and the chute guide 40*a* configured to guide the upper surface side of the metal strip 2 in the winding line L2, and to introduce the metal strip 2 into the winding port 23 of the mandrel 20, in which the chute guide 40*a* includes the body frame 70, and the liner 72 being attached to the body frame 70, constituting at least part of the guide surface 42 that guides the metal strip 2, and having the lower friction coefficient than that of the body frame 70 and the lower hardness than that of the metal strip 2. Thus, it is possible to obtain the coiler device 1 provided with the chute guide 40*a*, which is capable of preventing occurrence of flaws on the surface of the metal strip 2 and stabilizing strip passage even when the metal strip 2 is the high-strength thick material.

The preferred embodiment of the present invention has been described above with reference to the drawings. It is to be understood, however, that the present invention is not limited only to the above-described embodiment. The shapes, combinations, and other features of the respective constituents shown in the above-described embodiment are mere examples, and various modifications based on design requirements and the like are possible within the range not departing from the gist of the present invention.

Figure 8:
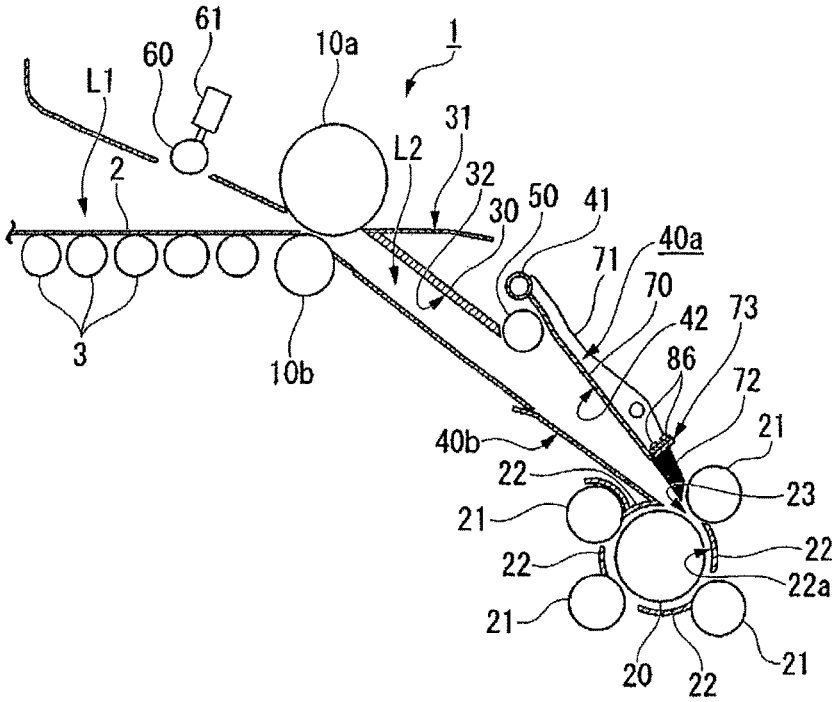
FIG. 8 is an overall configuration diagram showing a coiler device according to another embodiment of the present invention.

For example, the present invention may adopt the following aspect shown in FIG. 8. Note that in the following description, constituents which are identical or similar to those in the above-mentioned embodiment will be denoted by the same reference numerals and the description thereof will be either simplified or omitted.

FIG. 8 is an overall configuration diagram showing the coiler device 1 according to another embodiment of the present invention.

As shown in FIG. 8, the liner 72 of the other embodiment constitutes a downstream end of the chute guide 40*a*. The liner 72 is detachably attached to the body frame 70 by using the attachment units 73 formed from screw members 86. This configuration makes it possible to secure a thickness of the liner 72 and to ensure a large scrape margin. Thus, it is possible to reduce the frequency of replacement of the liner 72. It is to be noted, however, that the weight of the liner 72 becomes larger than that in the above-described embodiment.

Meanwhile, for example, the embodiments have described the configuration in which the liner is formed from the multiple pieces. However, the present invention is not limited only to this configuration. For instance, the liner may be formed from a single piece.

EXPLANATION OF REFERENCE NUMERALS

1 coiler device
2 metal strip
10*a*, 10*b* pinch roller
20 mandrel
23 winding port
40*a* chute guide
42 guide surface
70 body frame
72 liner
72*a* piece
73 attachment unit
74 frame body
75 slide groove
76 slide piece
77 screw member
80 engagement protrusion
82 first opening
83 second opening
L1 pass line
L2 winding line

The invention claimed is:

1. A coiler device provided with a chute guide, comprising:
- a pinch roller configured to guide a metal strip being conveyed along a pass line to a winding line bent from the pass line;
- a mandrel disposed ahead of the winding line and configured to wind up the metal strip; and
- a chute guide configured to guide an upper surface side of the metal strip in the winding line, and to introduce the metal strip into a winding port of the mandrel,
- wherein the chute guide comprises
  - a body frame;
  - a liner being attached to a downstream end of the body frame in the winding line, said liner constituting at least part of a guide surface to guide the metal strip, said liner having a lower friction coefficient than a friction coefficient of the body frame and a lower hardness than a hardness of the metal strip; and
- an attachment unit configured to detachably attach the liner to the body frame, and wherein the attachment unit includes:
  - a frame body provided to the body frame,
  - a slide groove provided in the liner,
  - a slide piece configured to be engaged with the slide groove, and to sandwich the frame body in conjunction with the liner, and
  - a screw member configured to fasten and fix the slide piece to the liner.

2. The coiler device provided with a chute guide according to claim 1, wherein
- the slide piece includes an engagement protrusion configured to be engaged with the slide groove, and
- the slide groove includes
- a first opening opened with a larger width than a width of the engagement protrusion, and a second opening opened with a smaller width than the width of the engagement protrusion.

3. The coiler device provided with a chute guide according to claim 2, wherein
- the liner includes a plurality of pieces arranged in a width direction of the winding line, and
- the plurality of pieces are detachably attached to the body frame independently of each other.

4. The coiler device provided with a chute guide according to claim 1, wherein
- the liner includes a plurality of pieces arranged in a width direction of the winding line, and
- the plurality of pieces are detachably attached to the body frame independently of each other.

5. The coiler device provided with a chute guide according to claim 1, wherein the liner is attached only at a downstream end of the body frame in the winding line.

6. The coiler device provided with a chute guide according to claim 1, wherein the liner extends beyond the downstream end of the body frame in the winding line.

* * * * *